US006336236B1

(12) United States Patent
Dalton

(10) Patent No.: US 6,336,236 B1
(45) Date of Patent: Jan. 8, 2002

(54) SNUGGLE PILLOW

(76) Inventor: Steve Dalton, 2811 Spring Rd., Roanoke, VA (US) 24015

( * ) Notice: Subject to any disclaimer, the term of this patent is extended or adjusted under 35 U.S.C. 154(b) by 0 days.

(21) Appl. No.: 09/435,440

(22) Filed: Nov. 22, 1999

(51) Int. Cl.[7] ..... A47C 20/02
(52) U.S. Cl. ..... 5/636; 5/632; 5/645
(58) Field of Search ..... 5/636, 632, 638, 5/645, 646, 640, 733

(56) References Cited

U.S. PATENT DOCUMENTS

| | | | | | |
|---|---|---|---|---|---|
| 2,782,427 | A | * | 2/1957 | Ericson | 5/632 |
| 2,839,766 | A | * | 6/1958 | Hull | 5/632 |
| 3,883,906 | A | * | 5/1975 | Sumpter | 5/632 |
| 4,821,355 | A | * | 4/1989 | Burkhardt | 5/636 |
| D316,353 | S | * | 4/1991 | Dobson | D6/601 |
| 5,159,727 | A | * | 11/1992 | McCracken | 5/655 |
| 5,168,590 | A | * | 12/1992 | O'Sullivan | 5/636 X |
| 5,214,814 | A | * | 6/1993 | Eremita et al. | 5/636 |
| 5,533,218 | A | * | 7/1996 | Fahy | 5/636 |
| 5,604,944 | A | | 2/1997 | Meade | |
| D381,234 | S | | 7/1997 | Lupoff | |
| 5,644,809 | A | * | 7/1997 | Olson | 5/636 |
| 5,661,862 | A | | 9/1997 | Rynak | |
| D387,599 | S | | 12/1997 | Rynak | |
| 5,907,876 | A | * | 6/1999 | Schwabe | 5/646 |
| 6,041,458 | A | * | 3/2000 | Vickers et al. | 5/636 |
| 6,079,066 | A | * | 6/2000 | Backlund | 5/636 |

* cited by examiner

*Primary Examiner*—Lynne H. Browne
*Assistant Examiner*—James M Hewitt
(74) *Attorney, Agent, or Firm*—James W. Hiney

(57) ABSTRACT

A snuggle pillow for use by two individuals including a main support pillow with apetures designed to accomodate the arms of the individuals and detachable cushion pads able to be attached thereto to facilitate intimacy of the two individuals without causing physical discomfort.

8 Claims, 5 Drawing Sheets

SNUGGLE PILLOW

This pillow relates to a pillow to be used by couples when they seek to snuggle and engage in "pillow talk" as it were. The pillow is especially designed for allowing both closeness and comfort while engaging in intimate discourse about topics of the couple's choice.

Henceforth, pillows were designed with only one sleeper in mind. The typical pillow is designed for use by one sleeper and is usually not large enough for two people to share. When two people lie facing one another there is the problem of how to stay comfortable. Using conventional pillows, people will tend to extend the lower arm above their head under the pillow so as to provide support for the head and pillow. Such an arrangement results in the circulation to the arm being cut off with a sharp rise in discomfort. When two pillows are used each participant extends an arm under his or her pillow with the resulting circulation problems and with the added problem of not being able to be too close to one another due to the abutting pillows. If a pillow is folded the folded up portion tends to abut the other's head and in general is not satisfactory. Folding each others arms in front of one another also forces the couple apart as the folded arms require space.

BACKGROUND ART

There have been several attempts to design modified pillows for various reasons. The patent to Sumpler, U.S. Pat. No. 3,883,906, shows such a design. The Sumpler patent is designed for one user and allows for him to extend his arms outward over his head when lying in a prone position. The design is for one person only and only allows the user to employ it while he or she is in a prone position, flat on one's stomach. It is difficult to see how one could use it while sleeping on one's side.

U.S. Design Pat. No. 381,234, shows a pillow for two users, a human and a pet. One section of the pillow is elevated and the other is of a lower height. There is no provision shown for two humans and no arm passageways.

The patent to Ryndak, U.S. Pat. No. 5,661,862, shows a pillow configured for one user but having different portions that allow for a sleeper to attain maximum comfort whether he be on his right side, left side or back. The pillow allows the head to be supported at different levels for side versus back use.

Another version of a specially designed pillow for one user by the same inventor, Ryndak, is shown in U.S. Design Pat. No. 387,599, which shows a two level pillow for supporting a persons head.

The U.S. Pat. No. 5,604,944, to Meade, shows a head rest which is adapted to be placed atop the arm and allow one person to rest his head on the device without impeding circulation.

None of the background art shows a pillow designed for two people which allows them to snuggle while providing a place for their respective arms without cutting off the circulation to them and further providing adustability in height to each of the people.

GENERAL DESCRIPTION OF THE INVENTION

The instant invention allows for two people to snuggle and get cozy without the usual attendant problems of losing all semblance of comfort in the process. The instant pillow may be constructed of one piece material suitable in characteristics to support the users head(s) and allow for extension of their respective arms. The pillow has arm passages which allow for one arm to cross over the other arm in a central chamber and has extension chambers which allow for one's hands to reside comfortably within the confines of the pillow. An added bonus is that as the arms and,hands are covered the users do not have to worry about chill on those cool or cold evenings when they are using the pillow. The remaining arms are extended alongside their respective bodies and in the winter are safely ensconced under blankets or a comforter.

The pillow is also adjustable to accommodate different sized people and has stuffed pads which can vary in thickness and are attached to the main pillow by Velcro fasteners or the like. These pads allow for larger framed people to select a thick pad to facilitate their head and shoulder size while more petite frames may not even need a pad to find a comfortable position on the pillow.

The pillow can be fabricated of a solid material with appropriate arms holes and chambers or it can be fashioned of a cover material with apertures in which to stuff padding to conform it to the intended user's frames to make more of a custom fitted article. It can be made of Styrofoam or stuffed with Styrofoam, ticking, goose feathers or other like material generally used in standard pillows.

A side benefit of this pillow is that if one of the users is absent the other can use it as an individual pillow which allows for extension of the arm and adjustablity of the height for that user alone.

OBJECTS OF THE INVENTION

Accordingly, it is an object of this invention to provide a pillow for use by two individuals in a manner to accommodate frontal closeness while facing one another while lying on their sides.

It is another object of this invention to provide a pillow for allowing a pair of users arms to cross through and underneath or within the pillow so as to allow for comfort and free circulation of blood within their respective arms.

Yet another object of this invention is to provide a two user pillow which can be adjusted for user frame variances by attaching pads to the top surface of the pillow or by increasing the stuffing of the interior or both.

A further object of this invention is to provide a pillow for multiple users which can be used by one user when the other user is absent.

Still another object of this invention is to provide a multiple user pillow which allows for custom fitting and maximum comfort to the users.

BRIEF DESCRIPTION OF THE DRAWINGS

These and other objects will become apparent when reference is had to the accompanying drawings in which.

DETAILED DESCRIPTION OF THE DRAWINGS

Figure 1:
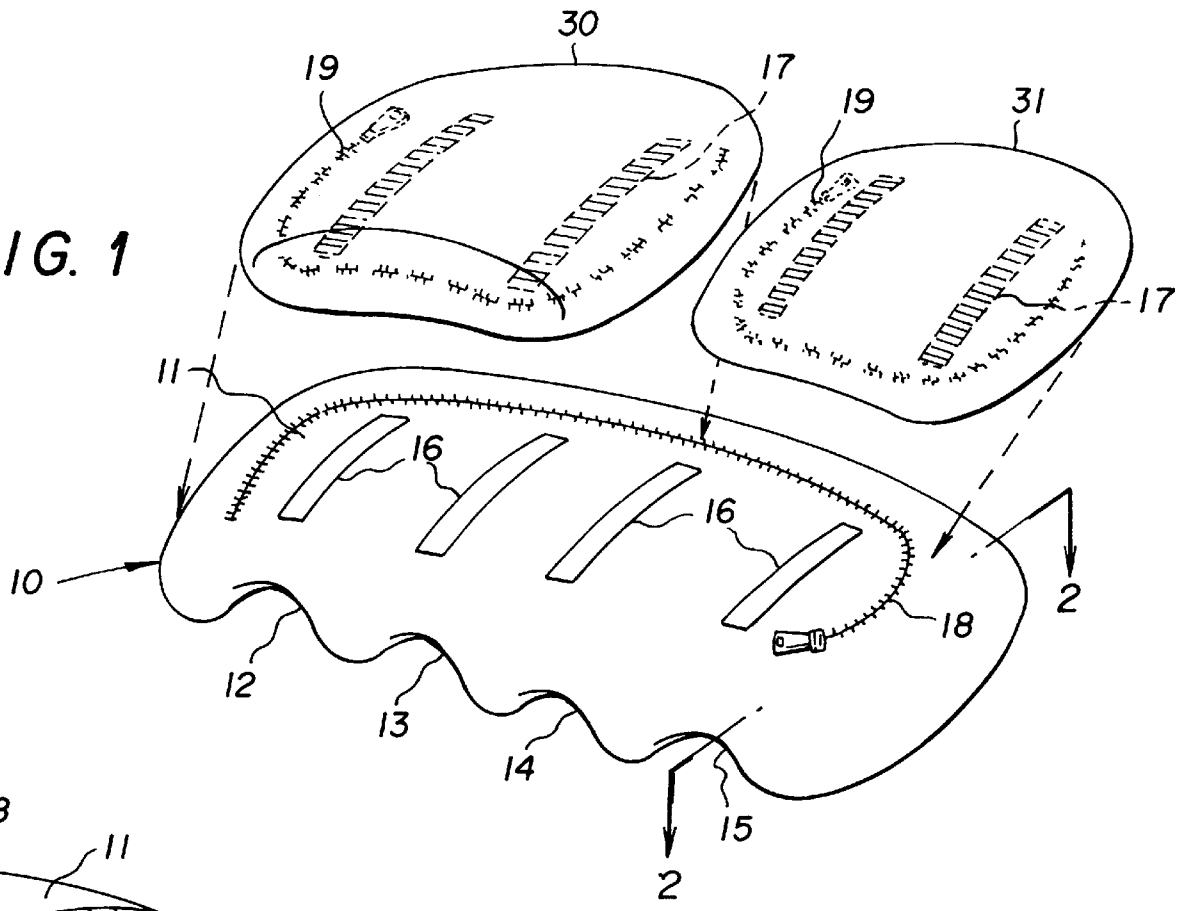
FIG. 1 is a perspective view of the pillow 10 of this invention showing pads 30 and 31 atop it.

Referring now to FIG. 1 there is shown a perspective view of the first embodiment of a pillow 10. The pillow has a top surface 11 and a series of openings, 12, 13, 14 and 15 along the front of the pillow. A series of strips 16 hold Velcro™ or similar contact adherence materials to engage with a corresponding series of strips 17 on two pads 30 and 31 which rest atop the pillow. The attaching strips 16/17 hold the pads in place.

Each pad 30 and 31 has a zippered opening 19 into which may be stuffed pad or pillow stuffing material such as ticking, goose down, or a similar plastic stuffing. Pillow 10 also has a zippered opening 18 into which similar stuffing may be placed to conform the pillow to the shape and frame of a user. The philosophy of the pillow use is to make it as comfortable as possible and to accomplish that result, padding may be added or subtracted to accommodate the shape of the user.

Figure 2:
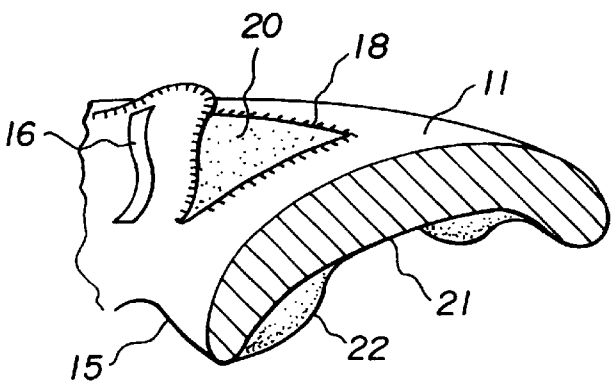
FIG. 2 is a cross sectional view taken along line 2—2 of FIG. 1 and showing the configuration of the pillow.

FIG. 2 shows a cross-sectional view of the pillow. Zippered enclosure can be opened as shown to allow insertion of resilient material such as 20. A chamber 21 is formed under the pillow which is supported by portions such as 22.

Figures 3, 4:
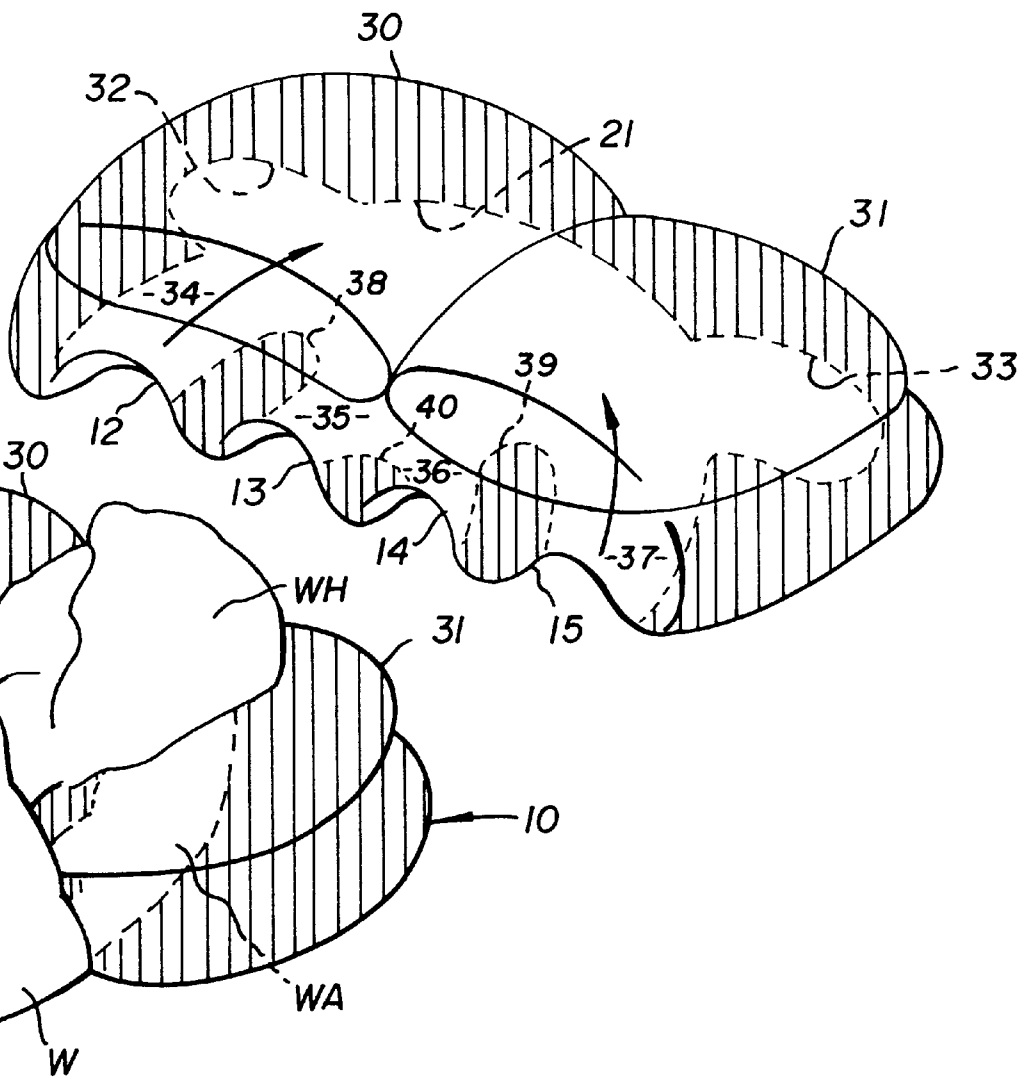
FIG. 3 is a perspective view of the pillow of FIG. 1 showing the internal passageways through which users arms extend.
FIG. 4 is the same view as FIG. 3 but showing two users in position using the pillow to facilitate face-to-face closeness.

FIGS. 3 and 4 show the pillow in more detail with the passageways through which users arms protrude shown in detail. As shown, opening 12 opens into passageway 34, opening 13 opens into passageway 35, opening 14 opens into passageway 36 and opening 15 opens into passageway 37. Separating passageways 34, 35, 36 and 37 are protrusions 38, 39 and 40. A large chamber 21 is formed in and underneath the pillow which also has subchambers 32 and 33 for accommodating users hands once their arms are extended beneath the pillow and are crossed. FIG. 4 shows the pillow in use with a man M and female W lying face to face and using the pillow to accommodate their arms such as WA. Their heads MH and WH lie upon the pillow pads which may have stuffing inserted or removed to accommodate their head and shoulder sizes.

Figure 5:
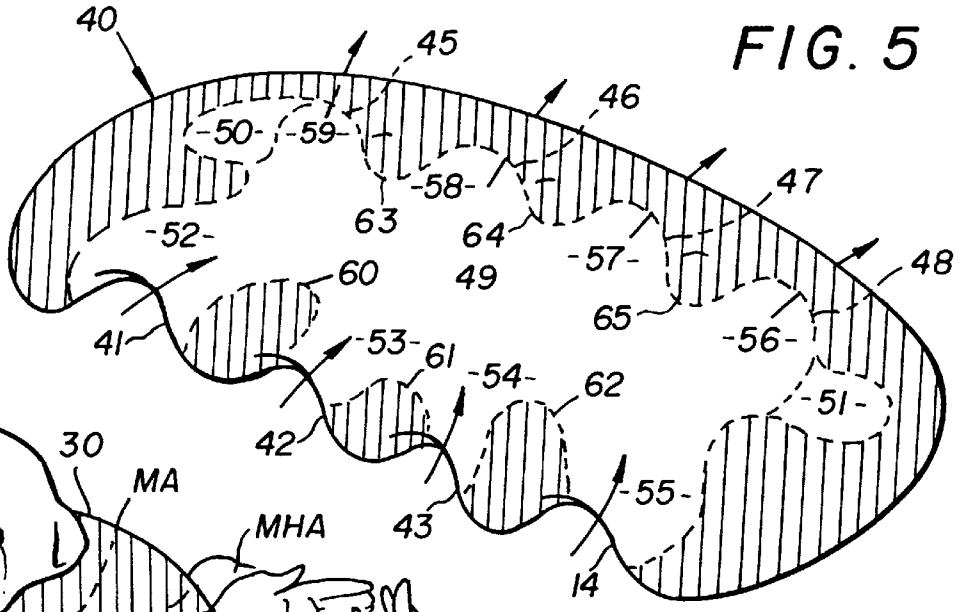
FIG. 5 is a perspective view of a second embodiment of the invention showing multiple apertures for arms to extend through, FIG. 6 is the same view as FIG. 5 but showing a couple using the pillow for closeness.
Figure 6:
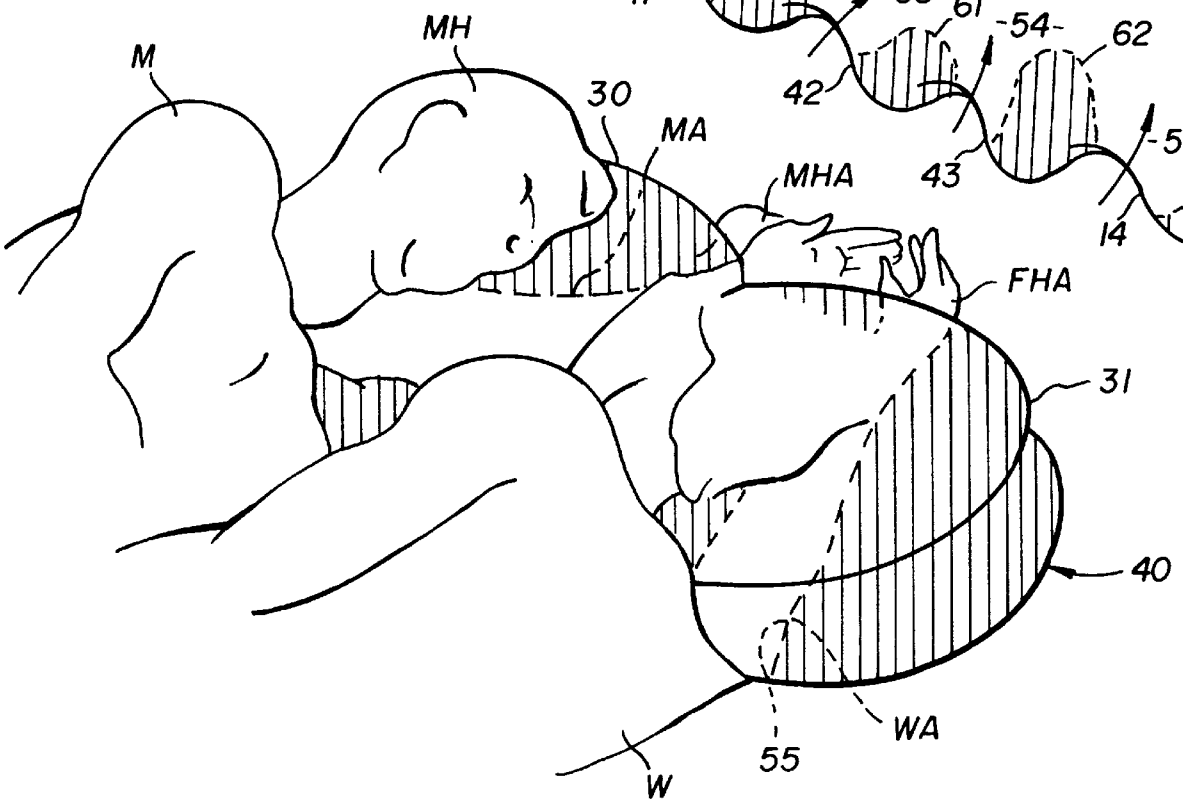

FIGS. 5 and 6 show a second embodiment of the pillow as 40. Pillow 40 has a series of openings 41, 42, 43 and 44 along the front edge thereof which open into a series of passageways, 52, 53, 54 and 55. They are separated by protruding portions 60, 61 and 62 and, in turn, communicate with a large chamber 49. On the back side of the pillow 40 are a series of openings 45,46, 47 and 48 which communicate with passageways 59, 58, 57, and 56, respectively, and in turn open into chamber 49. Chamber 49 and the various passageways allow users to cross their arms over as in pillow 10 and leave their hands in areas 50 and 51 or to extend them through and out of the pillow as shown in FIG. 6 to as to hold hands. The users M and W have their arms such as WA extending through the pillow and have their hands, MHA and WHA, outside so as to be able to hold hands. Their other arms and hands, not shown, extend in through the pillow by openings 42 and 43 allowing them to snuggle closer. Pillow 40 thus provides several options on how a couple will place their hands and arms both as a matter of choice and of comfort.

Figure 7:
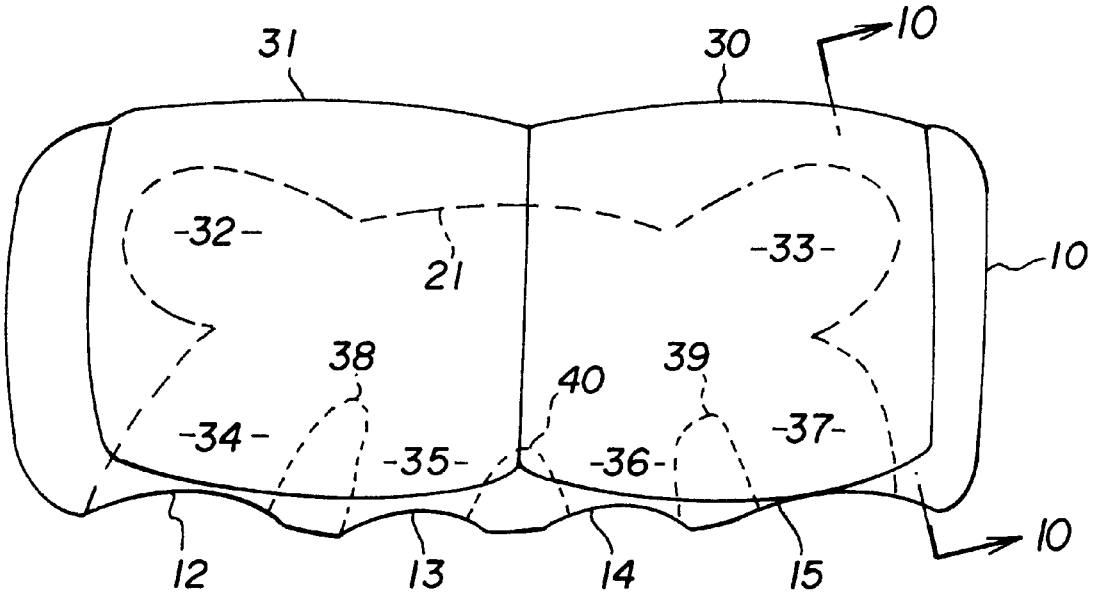
FIG. 7 is a plan view of the first embodiment shown in FIG. 1.
Figure 10:
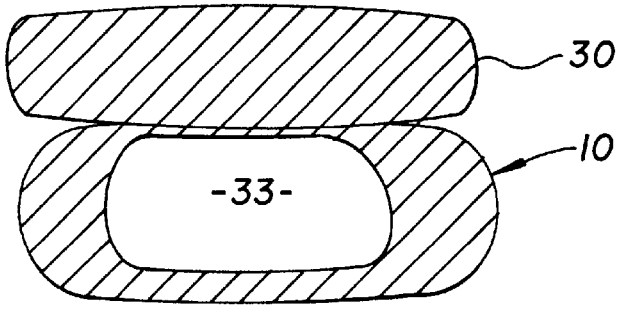
FIG. 10 is a cross sectional view taken along line 10—10 of FIG. 9.
Figure 11:
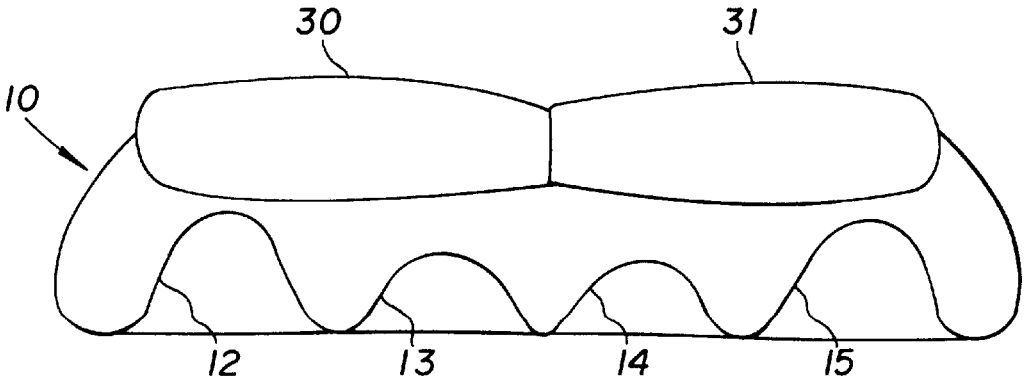
FIG. 11 is a front view of the pillow shown in FIG. 1.

FIG. 7 shows the pillow 10 in plan view with all the passageways shown in dotted lines. The protrusions 38, 39 and 40 separate the passageways. A cross section of a portion of the pillow is shown in FIG. 10 showing the hand chamber 33 and the pad 30. FIG. 11 shows the front view of pillow 10.

Figure 8:
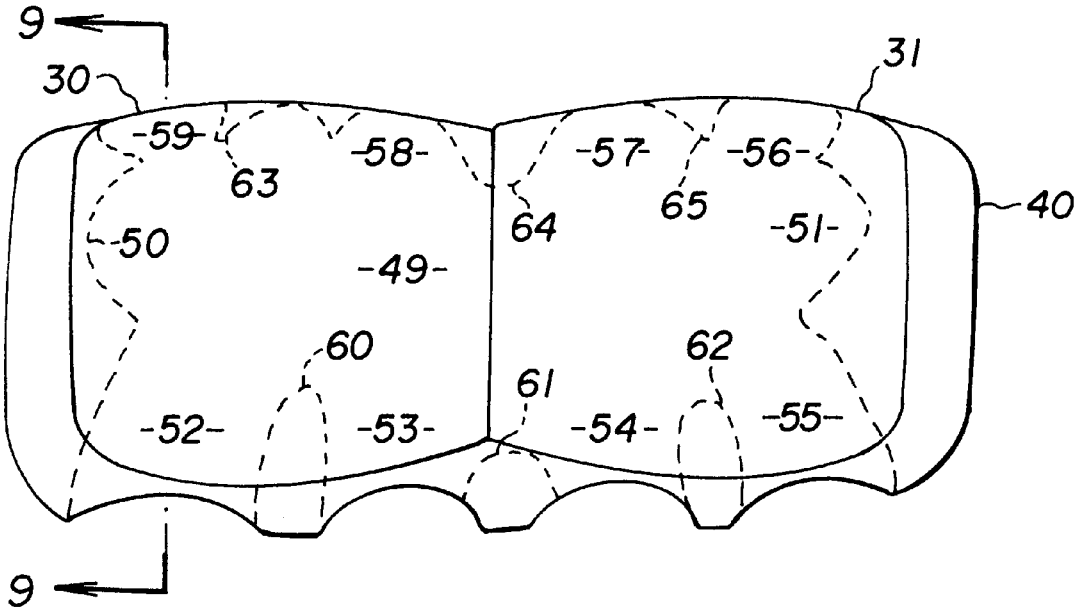
FIG. 8 is a plan view of the second embodiment of the invention as shown FIG. 5.
Figure 9:
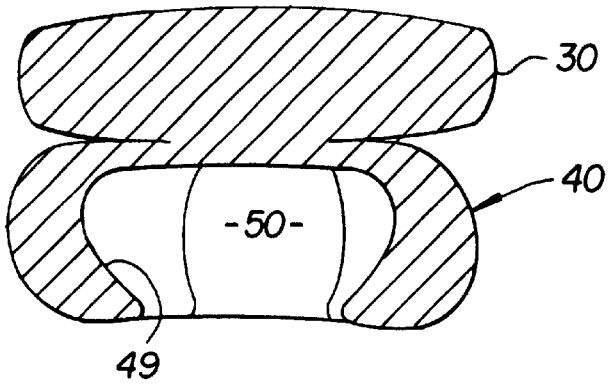
FIG. 9 is a cross sectional view taken along line 9—9 of FIG. 8.

FIG. 8 shows the pillow 40 in plan view with all the passageways shown in dotted lines. Protrustions 60, 61 and 62 separate the front passageways and protrusions 63, 64 and 65 separate the rear passageways.

While only two embodiments of this invention have been shown and described it will be obvious to those of ordinary skill in the art that many changes and modifications can be made without departing from the scope of the appended claims.

What is claimed is:

1. A snuggle pillow for use by two users while lying on their sides in a face-to-face position, said pillow comprising a first main pillow structure having a width to accommodate said two users and a depth to support their respective heads, said pillow having a front edge and a back edge, said pillow structure having passageway means within said structure which is adapted to accommodate the bottommost arm of each user without impinging upon the circulation of either arm, said passageway means comprises a central chamber within which the user's arms may be crossed, whereby said pillow allows the users to lie in a face-to-face position with their arms within said pillow and have their heads supported by said pillow.

2. A pillow as in claim 1 wherein said passageway means also includes at least two openings along the front edge of said pillow for insertion of the user's arms into said chamber.

3. A pillow as in claim 2 wherein said passageway means also includes two additional openings where the users may place the hands and forearms of their other arms.

4. A snuggle pillow for use by two users while lying on their sides in a face-to-face position, said pillow comprising:

a first main pillow structure having a width to accommodate said two users and a depth to support their respective heads, the pillow having a front edge and a back edge;

said pillow structure having passageway means within said structure which is adapted to accommodate the bottommost arm of each user without impinging upon the circulation of either arm;

a series of at least two openings along both the front edge and back edge all of which communicate with said passageway means, said openings configured to allow the users to extend their bottommost arm through said pillow and out the back edge so as to allow engagement of their hands by each other, the users also being able to keep their arms wholly within confines of said passageway means;

said pillow including a central chamber and two subchambers for accommodating users' hands when they elect to keep their arms wholly within confines of said pillow, whereby said pillow allows the users to lie in a face-to-face position with their arms within said pillow and have their heads supported by said pillow.

5. A snuggle pillow for use by two users while lying on their sides in a face-to-face position, said pillow comprising a first main pillow structure having a width to accommodate said two users and a depth to support their respective heads, said pillow having a front edge and a back edge, said pillow structure having passageway means within said structure which is adapted to accommodate the bottommost arm of each user without impinging upon circulation of either arm, said passageway means includes a central open chamber within said pillow, whereby said pillow allows the users to lie in a face-to-face position with their arms within said pillow and have their heads supported by said pillow.

6. A pillow for use by two users for allowing the users to lie on their sides in a face-to-face position, said pillow including a pillow structure having an empty central chamber, a first set of openings along one edge of said pillow to allow the users to put their arms through, a series of passageways communicating with said openings and said central chamber to allow the users to insert their arms and cross them within the confines of said central chamber.

7. A pillow as in claim 6 and including a second set of openings along an opposite edge of said pillow, a set of passageways in communication with said second openings and said central chamber to allow said users to extend their arms through said central chamber and out the openings in the opposite edge of said pillow.

8. A pillow as in claim 6 and including at least one pad means atop said pillow adapted to support a users head.

* * * * *